US006273757B1

(12) United States Patent
David et al.

(10) Patent No.: US 6,273,757 B1
(45) Date of Patent: Aug. 14, 2001

(54) RECEPTACLE WITH CONDUCTIVE CAVITY INSERTION PIECE INSERTED THEREINTO

(75) Inventors: James J. David, Mechanicsburg; David F. Fusselman, Middletown, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/437,374

(22) Filed: Nov. 10, 1999

(51) Int. Cl.[7] ..... H01R 13/648
(52) U.S. Cl. ..... 439/607
(58) Field of Search ..... 439/609, 607

(56) References Cited

U.S. PATENT DOCUMENTS

| | | | | |
|---|---|---|---|---|
| 4,659,163 | * | 4/1987 | Althouse et al. | 439/608 |
| 5,429,528 | | 7/1995 | Longueville et al. | 439/608 |
| 5,474,472 | | 12/1995 | Niwa et al. | 439/608 |
| 5,608,188 | | 3/1997 | Choon et al. | 174/35 R |
| 5,637,015 | | 6/1997 | Tan et al. | 439/607 |
| 5,685,739 | | 11/1997 | Davis et al. | 439/607 |
| 5,755,595 | * | 5/1998 | Davis et al. | 439/607 |
| 5,797,770 | * | 8/1998 | Davis et al. | 439/607 |
| 5,800,192 | | 9/1998 | David et al. | 439/188 |
| 5,984,726 | * | 11/1999 | Wu | 439/607 |
| 6,036,544 | * | 3/2000 | Brunker et al. | 439/607 |
| 6,053,773 | * | 4/2000 | Wu | 439/609 |
| 6,059,581 | * | 5/2000 | Wu | 439/79 |
| 6,099,351 | * | 8/2000 | Wu | 439/607 |
| 6,139,367 | * | 10/2000 | Yeh | 439/609 |

* cited by examiner

*Primary Examiner*—Brian Sircus
*Assistant Examiner*—Hae Moon Hyeon
(74) *Attorney, Agent, or Firm*—Woodcock Washburn Kurtz Mackiewicz & Norris LLP

(57) ABSTRACT

A receptacle has a housing that defines a connector-receiving cavity for receiving a connector therein. The housing has a front face and the cavity has a mouth thereof at the front face of the housing. A conductive exterior shield is fitted over the housing and has a pair of opposing side faces, each of which includes a rear edge opposite the mouth of the cavity and a slot at such rear edge. A conductive cavity insertion piece is inserted into the housing and has an interior arm and a pair of wings. The interior arm extends toward the mouth of the cavity and is in communication with the cavity to conductively contact an outer portion of the received connector. The interior arm releasably locks the connector as received within the cavity. Each wing is fitted within a respective slot at the rear edge of a side face of the exterior shield, whereby the wings conductively couple the arm to the exterior shield.

24 Claims, 2 Drawing Sheets

RECEPTACLE WITH CONDUCTIVE CAVITY INSERTION PIECE INSERTED THEREINTO

FIELD OF THE INVENTION

The present invention relates to electrical connectors such as receptacles which are adapted to be mounted to an underlying substrate. More particularly, the present intention relates to a receptacle such as a USB receptacle which includes a conductive cavity insertion piece inserted therein and conductively coupled to an exterior shield therearound.

BACKGROUND OF THE INVENTION

Receptacles which are adapted to be mounted on an underlying substrate are known in the art. The Universal Serial Bus (USB) receptacle, for example, is used in computer and computer peripheral devices such as printers, external drives, and other external input and output devices. In particular, such USB receptacle has been proposed for universal use in coupling many such computer and computer peripheral devices.

Typically, a USB receptacle includes an outer conductive shield member that defines a cavity having a mouth, an insulative interior member inside the cavity, and a plurality of contacts inside the cavity which generally extend from the mouth of such USB receptacle to engage an underlying substrate. The USB conductive shield, as is known, shields the interior of the USB receptacle from electromagnetic interference generated exteriorly, and also shields the exterior of such USB receptacle from electromagnetic interference generated interiorly. The USB shield typically includes a grounding leg that contacts the underlying substrate such that the shield is grounded to the substrate when the USB receptacle is mounted thereto.

Of course, a USB receptacle is constructed, formed, shaped, and otherwise designed to receive a complementary USB connector or plug which is coupled to a USB cable having a plurality of conductive wires. The reception of the USB connector in the USB receptacle thus conductively couples the wires in the USB cable to respective contacts in the USB receptacle. Typically, the USB receptacle includes one or more locking arms that extend generally toward the mouth of the receptacle. As is known, such locking arms cooperate with complementary locking devices on an outer portion of the USB connector to ensure that the USB connector is securely releasably locked in the USB receptacle upon proper reception thereinto, and also to conductively couple the outer portion of the USB connector to the USB receptacle shield and by extension to ground such outer portion to the substrate.

In particular, the USB connector outer portion has opposing broader lateral sides and opposing narrower lateral sides, and the locking devices on the USB connector comprise a pair of catches on each broader lateral side. Correspondingly, the locking arms of the receptacle are opposingly positioned within the USB receptacle cavity and include protrusions that are caught by the USB receptacle catches. Preferably, the locking arms opposingly contact both broader lateral sides of the USB connector outer portion to ensure a good lock on the USB connector and a good electrical connection with the outer portion thereof.

Typically, the USB receptacle is a single deck receptacle (i.e. a receptacle having a single USB cavity for receiving a single USB connector), the conductive shield thereof has upper and lower sides corresponding to the broad lateral sides of a received USB connector, and the upper and lower sides of such USB conductive shield are constructed to include the aforementioned locking arms as integrally formed members thereof. However, in the case of a multi-deck USB receptacle (i.e., a receptacle having two or more USB cavities stacked one on top of the other for simultaneously receiving two or more USB connectors), the USB conductive shield cannot provide integrally formed locking arms in locations internal thereto and not immediately adjacent such shield. Accordingly, a need exists for a conductive cavity insertion piece inserted within a multi-deck USB receptacle and having one or more appropriately positioned internal locking arms, where such internal locking arms are supplied for each cavity of the USB receptacle so that each received USB connector is opposingly releasably locked by locking arms on opposing sides thereof. A need also exists to ensure that such insertion piece is securely conductively coupled to the USB conductive shield.

SUMMARY OF THE INVENTION

The present invention satisfies the aforementioned needs by providing a receptacle having a housing that defines a connector-receiving cavity for receiving a connector therein. The housing has a front face and the cavity has a mouth thereof at the front face of the housing. A conductive exterior shield is fitted over the housing and has a pair of generally opposing side faces, each of which includes a rear edge generally opposite the mouth of the cavity and a slot at such rear edge.

A conductive cavity insertion piece is inserted into the housing and has an interior arm and a pair of wings. The interior arm extends generally toward the mouth of the cavity and is in communication with the cavity to conductively contact an outer portion of the received connector. The interior arm releasably locks the connector as received within the cavity. Each wing is fitted within a respective slot at the rear edge of a side face of the exterior shield, whereby the wings conductively couple the arm to the exterior shield.

BRIEF DESCRIPTION OF THE DRAWINGS

The foregoing summary as well as the following detailed description of the present invention will be better understood when read in conjunction with the appended drawings. For the purpose of illustrating the invention, there are shown in the drawing embodiments which are presently preferred. As should be understood, however, the invention is not limited to the precise arrangements and instrumentalities shown. In the drawings.

DETAILED DESCRIPTION OF PREFERRED EMBODIMENTS

Figure 1:
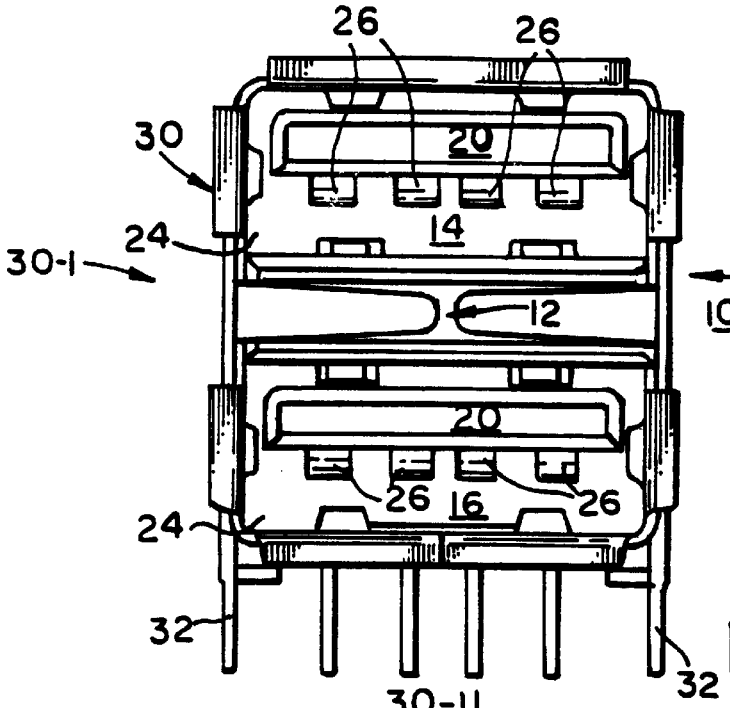
FIG. 1 is a front elevational view of a receptacle in accordance with one embodiment of the present invention.

Certain terminology may be used in the following description for convenience only and is not considered to be limiting. The words "left", "right", "supper", and "lower" designate directions in the drawings to which reference is made. The words "inwardly" and "outwardly" are further directions toward and away from, respectively, the geometric center of the referenced object. The terminology includes the words above specifically mentioned, derivatives thereof, and words of similar import.

Figure 2:
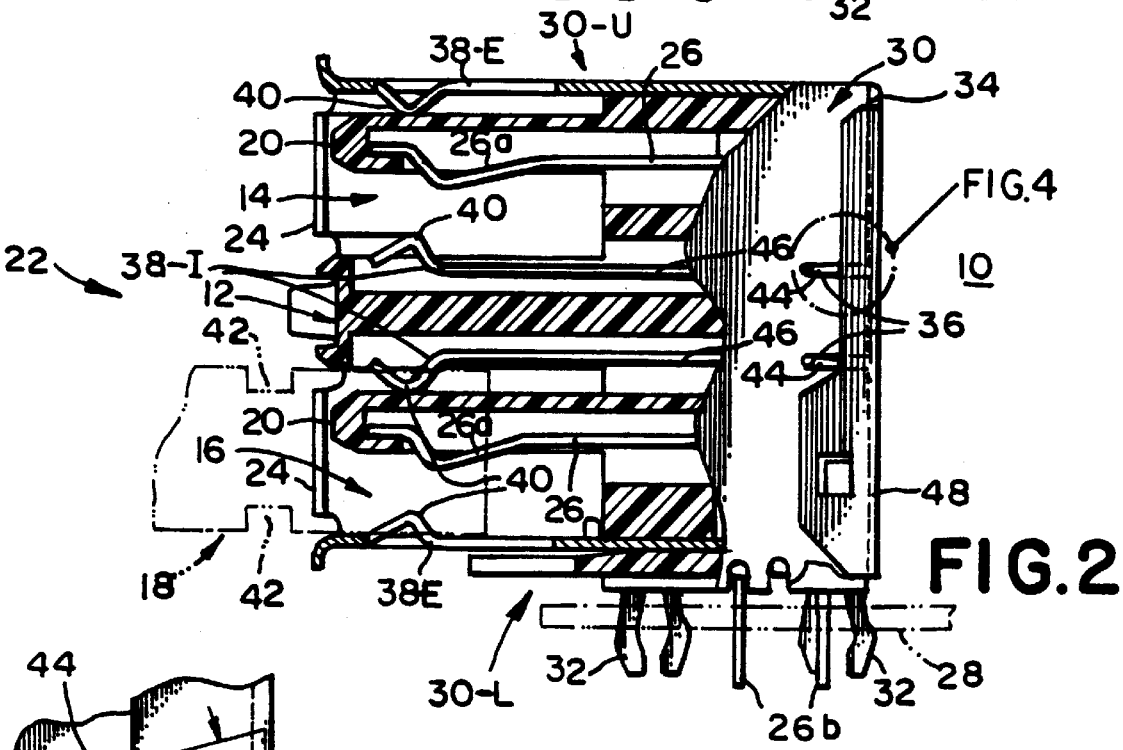
FIG. 2 is a partially cut away side elevational view of the receptacle shown in FIG. 1.

Referring to the drawings in detail wherein like numerals are used to indicate like elements throughout, there is shown in FIGS. 1 and 2 a receptacle 10 constructed in accordance with one embodiment of the present invention. As seen, the receptacle 10 is a double-deck receptacle comprising a double-deck housing 12 which defines an upper connector-receiving cavity 14 for receiving an upper connector (not shown) therein, and a lower connector-receiving cavity 16 for simultaneously receiving a lower connector 18 (shown in phantom) therein.

Although the receptacle 10 as shown is a double-deck receptacle, other numbers of levels in the connector 10 may be employed without departing from the spirit and scope of the present invention. For example, the connector 10 may be a single-deck connector, a triple-deck connector, a double-wide double-deck connector, etc.

In one embodiment of the present invention, and as shown, the receptacle 10 is a USB receptacle comprising a USB housing 12 for receiving a USB connector 18 therein. However, the receptacle 10 may be any other type of receptacle without departing from the spirit and scope of the present invention.

The USB housing 12 is an insulative member that includes, for each individual connector-receiving deck, a horizontal section 20 that extends horizontally to a front face 22 (FIG. 2) of the housing 12, wherein each cavity 14, 16 has a mouth 24 thereof at the front face 22 of the housing 12. The USB housing 12 also includes vertical sections (not shown) coupled to the horizontal sections 20. Such vertical sections, as well as other features, are generally known or would be apparent to the relevant public, but are not believed to be especially relevant in terms of the present invention, and therefore are not further described herein. The housing 12 may be constructed from any appropriate insulative material, in any appropriate manner, without departing from the spirit and scope of the present invention. For example, such housing 12 may be stamped, machined, and/or molded from an insulative material such as liquid crystal polymer (LCP) or nylon.

Included with each connector-receiving deck of the receptacle 10 and within each cavity 14, 16 are a number of conductive connector contacts 26 that extend along with the respective horizontal section 20 from the mouth 22 of the respective cavity 14, 16 at the front face 22 of the housing 12. As seen in FIGS. 1 and 2, in the case where the receptacle 10 is a USB connector, four such contacts 26 are present in each cavity 14, 16, generally at the underside of the respective horizontal section 20. However, other numbers of contacts 26 in each cavity 14,16 and other orientations of such contacts 26 in each cavity 14,16 may be employed without departing from the spirit and scope of the present invention. The contacts 26 may be constructed from any appropriate conductive material, in any appropriate manner, without departing from the spirit and scope of the present invention. For example, such contacts 26 may be stamped, machined, and/or molded from a conductive material such as phosphor-bronze.

As shown in FIG. 2, each contact 26 has a generally horizontal portion 26*a* that generally extends along with the respective horizontal section 20 , and a generally vertical portion 26*b* that is coupled to the horizontal portion 26*a* and that generally extends at a right angle with respect to such horizontal portion 26*a*. As should be understood, the distal portion of each vertical section 26*b* extends from the housing 12 and receptacle 10 and is coupled to an underlying substrate 28 (FIG. 2). While the receptacle 10 as shown is a 'right-angle' receptacle, it is to be understood that the receptacle 10 may instead be an 'in-line' receptacle with appropriate modifications (i.e. with extended horizontal sections 26*a* and without vertical sections 26*b* in the contacts 26) without departing from the spirit and scope of the present invention.

As best seen in FIG. 2, a conductive exterior shield 30 is fitted over the housing 12. As was mentioned above, the shield 30 shields the interior of the receptacle 10 from electromagnetic interference generated exteriorly, and also shields the exterior of such receptacle 10 from electromagnetic interference generated interiorly. Preferably, the shield includes one or more grounding legs 32 that contact the underlying substrate 28 such that the shield 30 is grounded to the substrate 28 when the receptacle 10 is mounted thereto. Each grounding leg 32 as shown may be a 'snap-in' leg 32 that snaps in to the underlying substrate 28, or may be another type of leg.

As shown, the shield 30 has a pair of generally opposing side faces 30-1, 30-2 (FIG. 1) and upper and lower generally opposing faces 30-U, 30-L (FIG. 2) that interconnect the side faces 30-1, 30-2. The shield 30 also has a front face corresponding to the front face 22 of the housing 12 and receptor 10, and an opposing rear face corresponding to the rear face of the housing 12 and receptor 10. The shield 30 may be constructed from any appropriate conductive material, in any appropriate manner, without departing from the spirit and scope of the present invention. For example, such shield 30 may be stamped, machined, and/or molded from a conductive material such as phosphor-bronze.

Figure 4:
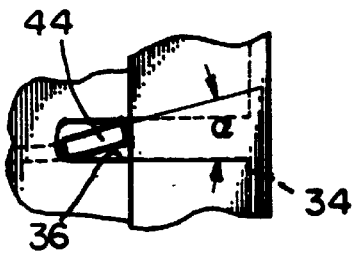
FIG. 4 is a close up view of a portion of the receptacle as seen in FIG. 2, and shows the interconnection between the conductive cavity insertion piece of FIG. 3 and a conductive exterior shield of the receptacle.

As seen in FIGS. 2 and 4, each side face 30-1, 30-2 of the shield 30 includes a rear edge 34 generally opposite the mouths 24 of the cavities 14,16. Preferably, each side face 30-1, 30-2 includes at least one slot 36 at the rear edge 34 thereof. As will be understood, each slot 36 on one side face 30-1, 30-2 has a corresponding slot 36 on the other side face 30-1, 30-2. It is expected that corresponding slots 36 will be in mirror image relationship with respect to each other, although such mirror image relationship is not necessary for effectuating the present invention.

As was referenced above, a USB receptacle 10 is constructed, formed, shaped, and otherwise designed to receive a complementary USB connector 18 (FIG. 2). The USB receptacle 10 typically includes opposing locking arms to securely releasably lock the received connector 18 in the receptacle 10 and to conductively couple the outer portion of the connector 18 to the receptacle shield 30. The locking arms of the receptacle 10 are opposingly positioned within the receptacle cavity 14,16 to ensure a good lock on the connector 18 and a good electrical connection with the outer portion thereof, and the upper and lower faces 30-U, 30-L of the shield 30 typically are constructed to include the aforementioned locking arms (exterior locking arms 38-E in FIG. 2) as integrally formed members thereof.

As seen, each exterior locking arm 38-E is positioned generally at one of the upper or lower faces 30-U, 30-L of the shield 30, extends generally toward the mouth 24 of the respective cavity 14,16, and is in communication with such cavity 14, 16 to conductively contact a respective outer portion of a received connector 18. Typically, each locking arm 38-E is formed to include a protrusion 40 that interacts with a catch 42 on the connector 18 during proper reception thereof.

However, and as was also referenced above, in the case of a multi-deck USB receptacle 10 as seen in FIGS. 1 and 2, the USB conductive shield 30 cannot provide integrally formed locking arms in locations internal thereto and not immediately adjacent such shield 30. Referring now to FIGS. 1–4, then, it is seen that in the present invention, a conductive cavity insertion piece 44 is inserted into the housing and has at least one interior arm 38-I and a pair of wings 46. The insertion piece 44 may be constructed from any appropriate conductive material, in any appropriate manner, without departing from the spirit and scope of the present invention. For example, such insertion piece 44 may be stamped, machined, and/or molded from a conductive material such as phosphor-bronze.

As may be appreciated, and like each exterior arm 38-E, each interior arm 38-I extends generally toward the mouth 24 of the respective cavity 14,16, when the insertion piece 44 is inserted into the receptacle 10, and is in communication with a cavity 14,16 to conductively contact a respective outer portion of a received connector 18, as is seen in FIGS. 1 and 2. Typically, and like each exterior arm 38-E, each interior locking arm 38-1 is formed to include a protrusion 40 that interacts with a catch 42 on the connector 18 during proper reception thereof. Thus, when an exterior arm 38-E associated with a cavity 14, 16 is not opposed in the cavity 14,16 by another exterior arm 38-E associated with the same cavity 14,16, an interior arm 38-I may be associated with such cavity 14,16 to cooperate in opposing combination with the exterior arm 38-E to releasably lock a connector 18 as received within the cavity 14,16.

Moreover, and as will be explained below, an interior arm 38-I on an insertion piece 44 may be employed instead of an external arm 38-E on the shield. Likewise, an interior arm 38-I may be associated with a cavity 14,16 to cooperate in opposing combination with another interior arm 38-I associated with the same cavity 14,16 to releasably lock a connector 18 as received within the cavity 14,16.

Figure 3:
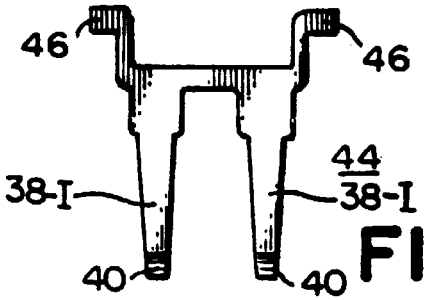
FIG. 3 is a top plan view of a conductive cavity insertion piece employed in connection with the receptacle of FIGS. 1 and 2.

In one embodiment of the present invention, and as seen in FIGS. 1 and 3, each insertion piece 44 has a pair of interior locking arms 38-I that extend generally toward the mouth 24 of the cavity 14,16, where each interior locking arm 38-I of the pair is in communication with the cavity 14,16 for conductively contacting an outer portion of the received connector 18. Each of the upper and lower faces 30-U, 30-L of the shield 30 likewise has a pair of exterior locking arms 38-E that extend generally toward the mouth 24 of the cavity 14, 16, where each exterior locking arm 38-E of the pair is in communication with the cavity 14, 16 for conductively contacting an outer portion of the received connector 18. Of course, other numbers of interior and exterior locking arms 38-I, 38-E may be located on each insertion piece 44 and on each of the upper and lower faces 30-U, 30-L without departing from the spirit and scope of the present invention.

As inserted into the receptacle 10, care must be taken to ensure that each insertion piece 44 makes good conductive contact with the receptacle shield 30, thereby ensuring that each insertion piece 44 conductively couples the outer portion of a received USB connector 18 to the receptacle shield 30 and by extension to ground such outer portion to the substrate 28. Accordingly, and as seen in FIGS. 2–4, the insertion piece 44 is provided with the pair of wings 46, where each wing 46 is fitted within a respective corresponding slot 36 at the rear edge 34 of a side face 30-1, 30-2 of the exterior shield 30, and such fitted wings 46 conductively couple the attached interior locking arm 38-I to the exterior shield 30. As best seen in FIG. 3, each wing 46 extends from the insertion piece 44 generally perpendicularly with respect to the respective corresponding slot 36 and also generally perpendicularly with respect to the interior locking arm(s) 38-I of such insertion piece 44. Of course, each wing 46 may extend in any other manner from the insertion piece 44 without departing from the spirit and scope of the present invention.

In one embodiment of the present invention, the insertion piece 44 is inserted into the housing 12 and receptacle 10 through the rear face thereof generally opposite the front face 22 thereof. In doing so, the wings 46 of such insertion piece 44 are moved into the respective slots 36. Such insertion requires that the receptacle 10 and housing 12 have appropriate space therein for receiving the insertion piece 44. Methods of creating the space may vary depending on the dimensions and shape of the insertion piece 44, but should be apparent to the relevant public. Accordingly, further discussion in this regard is deemed unnecessary. The shield 30 may include a back panel 48 that is folded down to lock each inserted insertion piece 44 in place, as is shown in FIG. 2, although other securing devices may be employed. In certain cases, in fact, no securing devices may be necessary.

As inserted, and as seen in FIGS. 1 and 2, the insertion piece 44 generally resides in a plane generally parallel to the upper and lower faces 30-U, 30-L of the exterior shield 30. Preferably, each wing 46 maintains an interference fit within the respective slot 36 to ensure the aforementioned good conductive contact between the insertion piece 44 and the shield 30. Such interference fit is maintained in one embodiment of the present invention by having each wing 46 generally reside at an angle a within the respective slot 36, as is best seen in FIG. 4. Such angle a may be about 15 degrees, although other angles a may be employed without departing from the spirit and scope of the present invention. As may be understood, such angle a is created in a wing 46 by bending the wing 46 or forming the wing 46 at such angle a with respect to the plane of the insertion piece 44 during formation of such insertion piece 44. Alternatively, the wing 46 is planar with the remainder of the insertion piece 44 and the slot 36 is at the angle $\alpha$.

In one embodiment of the present invention, and as best seen in FIGS. 1 and 2, the housing 12 has the aforementioned upper and lower cavities 14, 16, the pair of side faces 30-1, 30-2 of the exterior shield 30 each include upper and lower slots 36 at the rear edge 34 thereof, and the receptacle comprises conductive upper and lower cavity insertion pieces 44. The upper cavity insertion piece 44 has one or more upper interior locking arms 38-I, and a pair of upper wings 46 that fit into the respective upper slots 36, and the lower cavity insertion piece 44 likewise has one or more lower interior locking arms 38-I, and a pair of lower wings 46 that fit into the respective lower slots 36. In such embodiment, the upper cavity and lower cavity insertion pieces 44 are generally planar, generally identical, face each other generally in mirror image, and are each generally symmetrical about an axis extending parallel to the pair of side faces 30-1, 30-2 of the exterior shield.

As should be understood, in such embodiment, the upper exterior locking arm(s) 38-E (i.e., the arm(s) positioned generally at the upper face 30-U of the shield 30) and the upper interior arm(s) 38-I in opposing combination releasably lock a connector 18 as received within the upper cavity (not shown). Likewise, the lower exterior locking arm(s) 38-E (i.e., the arm(s) positioned generally at the lower face 30-LU of the shield 30) and the lower interior arm(s) 38-I in opposing combination releasably lock a connector 18 as received within the lower cavity.

Figure 5:
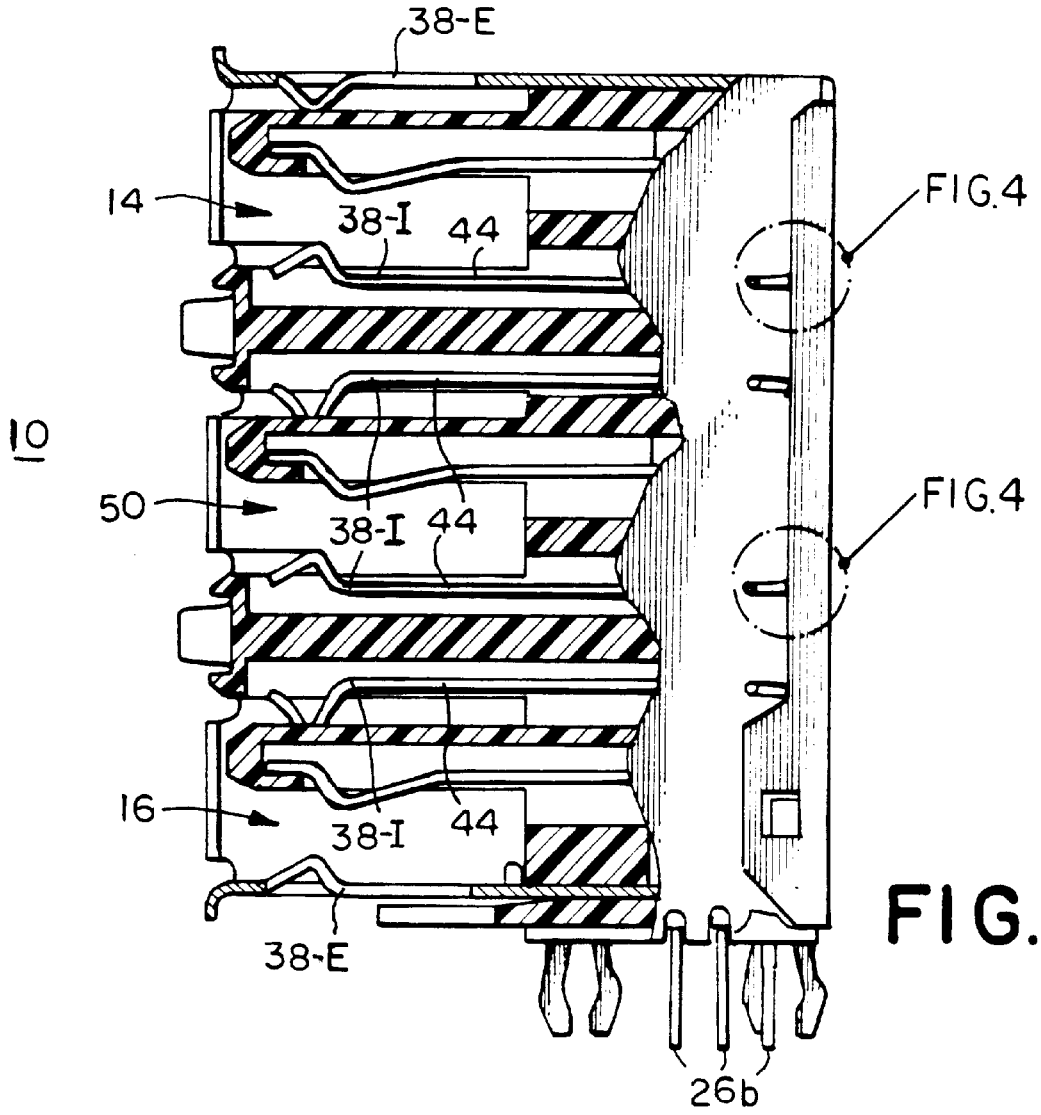
FIG. 5 is a partially cut away side elevational view of a receptacle in accordance with another embodiment of the present invention.

As should now be evident, any number of cavities 14, 16, with appropriate corresponding interior insertion pieces 44 may be employed without departing from the spirit and scope of the present invention. For example, in another embodiment of the present invention, and as seen in FIG. 5, the receptacle 10 has a third or middle cavity 50 for simultaneously accepting a third or middle connector 18 (not shown in FIG. 5). As may now be understood, in such embodiment, the pair of side faces 30-1, 30-2 of the exterior shield 30 each further include upper middle and lower middle slots 36 at the rear edge 34 thereof, and the receptacle further comprises conductive upper middle and lower middle cavity insertion pieces 44.

The upper middle cavity insertion piece 44 has one or more upper middle interior locking arms 38-I, and a pair of upper middle wings 46 that fit into the respective upper middle slots 36, and the lower middle cavity insertion piece 44 likewise has one or more lower middle interior locking arms 38-I, and a pair of lower middle wings 46 that fit into the respective lower middle slots 36. In such embodiment, the upper middle cavity and lower middle cavity insertion pieces 44 are generally planar, generally identical, face each other generally in mirror image, and are each generally symmetrical about an axis extending parallel to the pair of side faces 30-1, 30-2 of the exterior shield. As should be understood, in such further embodiment, the upper middle interior locking arm(s) 38-I and the lower middle interior arm(s) 38-I in opposing combination releasably lock the aforementioned middle connector 18 (not shown in FIG. 5) as received within the middle cavity 50.

In the foregoing description, it can be seen that the present invention comprises a new and useful receptacle 10 having a conductive cavity insertion piece 44 inserted thereinto. The insertion piece 44 has one or more appropriately positioned internal locking arms 38-I, where such internal locking arms 38-I are supplied in the receptacle 10 so that a connector 18 received therein is releasably locked by locking arms on opposing sides thereof. The insertion piece 44 is securely conductively coupled to the receptacle shield 30. It should be appreciated that changes could be made to the embodiments described above without departing from the inventive concepts thereof. For one example, one or more interior locking arms 38-I may replace one or more exterior locking arms 38-E. For another example, one or more interior locking arms 38-I may be employed in an un-opposed manner. It should be understood, therefore, that this invention is not limited to the particular embodiments disclosed, but it is intended to cover modifications within the spirit and scope of the present invention as defined by the appended claims.

What is claimed is:

1. A receptacle comprising:

a housing defining a connector-receiving cavity for receiving a connector therein, the housing having a front face and the cavity having a mouth thereof at the front face of the housing;

a conductive exterior shield fitted over the housing and having a pair of generally opposing side faces, the pair of side faces each including a rear edge generally opposite the mouth of the cavity, and each including a slot at the rear edge thereof which opens to such rear edge; and a conductive cavity insertion piece inserted into the housing and having:

an interior arm extending generally toward the mouth of the cavity and being in communication with the cavity for conductively contacting an outer portion of the received connector; and a pair of wings, each wing fitted within a respective open slot at the rear edge of a side face of the exterior shield, the pair of wings conductively coupling the arm to the exterior shield.

2. The receptacle of claim 1 wherein the exterior shield has upper and lower generally opposing faces interconnecting the side faces, wherein the exterior shield defines an exterior arm positioned generally at one of the upper face and lower face, the exterior arm extending generally toward the mouth of the cavity and being in communication with the cavity for conductively contacting an opposing outer portion of the received connector.

3. The receptacle of claim 1 wherein:

the housing defines an upper connector-receiving cavity for receiving an upper connector therein and a lower connector-receiving cavity for simultaneously receiving a lower connector therein, the upper and lower cavities each having a mouth thereof at the front face of the housing;

the pair of side faces of the exterior shield each include upper and lower slots at the rear edge thereof; and the receptacle comprises:

a conductive upper cavity insertion piece having:

an upper interior arm extending generally toward the mouth of the upper cavity and in communication with the upper cavity of the housing for conductively contacting a lower outer portion of the received upper connector; and a pair of upper wings, each upper wing fitted within a respective upper slot at the rear edge of the pair of side faces of the exterior shield, the pair of upper wings conductively coupling the upper interior arm to the exterior shield; and a conductive lower cavity insertion piece having:

a lower interior arm extending generally toward the mouth of the lower cavity and in communication with the lower cavity of the housing for conductively contacting an upper outer portion of the received lower connector; and a pair of lower wings, each lower wing fitted within a respective lower slot at the rear edge of the pair of side faces of the exterior shield, the pair of lower wings conductively coupling the lower interior arm to the exterior shield.

4. The receptacle of claim 3 wherein the upper cavity and lower cavity insertion pieces are generally planar, generally identical, face each other generally in mirror image, and are each generally symmetrical about an axis extending parallel to the pair of side faces of the exterior shield.

5. The receptacle of claim 3 wherein the exterior shield has upper and lower generally opposing faces interconnecting the side faces, and wherein the exterior shield defines:

an upper exterior arm positioned generally at the upper face, the upper exterior arm extending generally toward the mouth of the upper cavity and being in communication with the upper cavity for conductively contacting an opposing outer portion of the connector received therein; and a lower exterior arm positioned generally at the lower face, the lower exterior arm extending generally toward the mouth of the lower cavity and being in communication with the lower cavity for conductively contacting an opposing outer portion of the connector received therein.

6. The receptacle of claim 3 wherein:

the housing defines an upper connector-receiving cavity for receiving an upper connector therein, a middle connector-receiving cavity for simultaneously receiving a middle connector therein, and a lower connector-receiving cavity for simultaneously receiving a lower connector therein, the upper, middle, and lower cavities each having a mouth thereof at the front face of the housing;

the pair of side faces of the exterior shield each include upper, upper middle, lower middle, and lower slots at the rear edge thereof;

the receptacle further comprising:

a conductive upper middle cavity insertion piece having:

an upper middle interior arm extending generally toward the mouth of the middle cavity and in communication with the middle cavity of the housing for conductively contacting an upper outer portion of the received middle connector; and a pair of upper middle wings, each upper middle wing fitted within a respective upper middle slot at the rear edge of the pair of side faces of the exterior shield, the pair of upper middle wings conductively coupling the upper middle interior arm to the exterior shield; and a conductive lower middle cavity insertion piece having:

a lower middle interior arm extending generally toward the mouth of the middle cavity and in communication with the middle cavity of the housing for conductively contacting a lower outer portion of the received middle connector; and a pair of lower middle wings, each lower middle wing fitted within a respective lower middle slot at the rear edge of the pair of side faces of the exterior shield, the pair of lower middle wings conductively coupling the lower middle interior arm to the exterior shield.

7. The receptacle of claim 6 wherein the upper middle cavity and lower middle cavity insertion pieces are generally planar, generally identical, face each other generally in mirror image, and are each generally symmetrical about an axis extending parallel to the upper face, lower face, and pair of side faces of the exterior shield.

8. The receptacle of claim 6 wherein the exterior shield has upper and lower generally opposing faces interconnecting the side faces, and wherein the exterior shield defines:

an upper exterior arm positioned generally at the upper face, the upper exterior arm extending generally toward the mouth of the upper cavity and being in communication with the upper cavity for conductively contacting an opposing outer portion of the connector received therein; and a lower exterior arm positioned generally at the lower face, the lower exterior arm extending generally toward the mouth of the lower cavity and being in communication with the lower cavity for conductively contacting an opposing outer portion of the connector received therein.

9. The receptacle of claim 1 wherein the insertion piece is inserted into the housing through a rear face thereof generally opposite the front face thereof.

10. The receptacle of claim 1 wherein the exterior shield has upper and lower generally opposing faces interconnecting the side faces, and wherein the insertion piece generally resides in a plane generally parallel to the upper and lower faces of the exterior shield.

11. The receptacle of claim 1 wherein each wing maintains an interference fit within the respective slot.

12. The receptacle of claim 1 wherein each wing generally resides at an angle within the respective slot.

13. The receptacle of claim 12 wherein each wing generally resides at an angle of about 15 degrees within the respective slot.

14. The receptacle of claim 1 comprising a USB housing for receiving a USB connector.

15. The receptacle of claim 14 comprising a double-deck USB housing defining an upper connector-receiving cavity for receiving an upper USB connector therein and a lower USB connector-receiving cavity for simultaneously receiving a lower USB connector therein.

16. The receptacle of claim 1 wherein the insertion piece has a pair of arms extending generally toward the mouth of the cavity and in communication with the cavity for conductively contacting an outer portion of the received connector.

17. The receptacle of claim 1 wherein each wing extends from the insertion piece generally perpendicularly with respect to the respective slot and generally perpendicularly with respect to the arm.

18. A receptacle comprising:

a housing defining a connector-receiving cavity for receiving a connector therein, the housing having a front face and the cavity having a mouth thereof at the front face of the housing; and a conductive exterior shield fitted over the housing and having a pair of generally opposing side faces, the pair of side faces each including a rear edge generally opposite the mouth of the cavity, and each including a slot at the rear edge thereof;

a conductive cavity insertion piece inserted into the housing and comprising:

an interior arm extending generally toward the mouth of the cavity and in communication with the cavity for conductively contacting an outer portion of the received connector; and a pair of wings, each wing fitted within a respective slot at the rear edge of a side face of the exterior shield, the pair of wings conductively coupling the arm to the exterior shield; and a back panel preventing the fitted wings from leaving the slots and thereby locking the inserted insertion piece within the housing.

19. The receptacle of claim 18 wherein such insertion piece is generally planar and wherein each wing generally resides at an angle with respect to the generally planar insertion piece, each wing thereby maintaining an interference fit within the respective slot.

20. The receptacle of claim 19 wherein each wing generally resides at an angle of about 15 degrees with respect to the generally planar insertion piece.

21. The receptacle of claim 18 wherein the insertion piece has a pair of arms extending generally toward the mouth of the cavity and in communication with the cavity for conductively contacting an outer portion of the received connector.

22. The receptacle of claim 18 wherein each wing extends from the insertion piece generally perpendicularly with respect to the arm.

23. A shielding arrangement for a receptacle having a housing defining a connector-receiving cavity for receiving a connector therein, the housing having a front face and the cavity having a mouth thereof at the front face of the housing, the shielding arrangement comprising:

a conductive exterior shield for being fitted over the housing and having a pair of generally opposing side faces, the pair of side faces each including a rear edge generally opposite the mouth of the cavity, and each including a slot at the rear edge thereof which opens to such rear edge; and a conductive cavity insertion piece for being inserted into the housing and having:

an interior arm for extending generally toward the mouth of the cavity and being in communication with the cavity for conductively contacting an outer portion of the received connector; and a pair of wings, each wing for being fitted within a respective open slot at the rear edge of a side face of the exterior shield, the pair of wings for conductively coupling the arm to the exterior shield.

24. A shielding arrangement for a receptacle having a housing defining a connector-receiving cavity for receiving a connector therein, the housing having a front face and the cavity having a mouth thereof at the front face of the housing, the shielding arrangement comprising:

a conductive exterior shield for being fitted over the housing and having a pair of generally opposing side faces, the pair of side faces each including a rear edge generally opposite the mouth of the cavity, and each including a slot at the rear edge thereof; and a conductive cavity insertion piece for being inserted into the housing and having:

an interior arm for extending generally toward the mouth of the cavity and being in communication with the cavity for conductively contacting an outer portion of the received connector;

a pair of wings, each wing for being fitted within a respective slot at the rear edge of a side face of the exterior shield, the pair of wings for conductively coupling the arm to the exterior shield; and a back panel for preventing the fitted wings from leaving the slots and thereby locking the inserted insertion piece within the housing.

* * * * *

UNITED STATES PATENT AND TRADEMARK OFFICE

CERTIFICATE OF CORRECTION

PATENT NO. : 6,273,757 B1
DATED : August 14, 2001
INVENTOR(S) : James J. David et al.

It is certified that error appears in the above-identified patent and that said Letters Patent is hereby corrected as shown below:

Column 3,
Line 1, please delete the word “supper” and insert the word -- upper. --
Line 17, after the word “therein”, the next sentence should begin with the word "Although”. The word “Although”, now begins a new paragraph.

Column 4,
Line 32, please delete the word “receptor” and insert the word -- receptacle. --

Column 6,
Lines 37, 38, 39, 41 and 43, please delete the letter “a” and insert the symbol -- α. --

Signed and Sealed this

Twentieth Day of August, 2002

*Attest:*

*Attesting Officer*

JAMES E. ROGAN
*Director of the United States Patent and Trademark Office*